US005778803A

United States Patent [19]

Machael

[11] Patent Number: 5,778,803

[45] Date of Patent: Jul. 14, 1998

[54] ADJUSTABLE HEIGHT LOAD BEARING SUPPORT STRUCTURE

[75] Inventor: Jay R. Machael, Muscatine, Iowa

[73] Assignee: Hon Industries Inc., Muscatine, Iowa

[21] Appl. No.: 730,304

[22] Filed: Oct. 11, 1996

Related U.S. Application Data

[63] Continuation-in-part of Ser. No. 634,592, Apr. 18, 1996.

[51] Int. Cl.[6] ..... A47B 9/00

[52] U.S. Cl. ..... 108/147; 248/588

[58] Field of Search ..... 108/147, 146, 108/144, 145; 248/188.2, 588, 589, 921

[56] References Cited

U.S. PATENT DOCUMENTS

| | | | |
|---|---|---|---|
| 318,593 | 5/1885 | Behrens | 108/147 X |
| 3,282,566 | 11/1966 | Clarke | 108/147 X |
| 4,312,491 | 1/1982 | Aondetto | 248/588 X |
| 4,511,110 | 4/1985 | Moller | 108/147 X |
| 4,551,300 | 11/1985 | Feutrel | 248/584 X |
| 4,638,610 | 1/1987 | Heikkinen | 108/147 X |
| 4,685,731 | 8/1987 | Migut | 108/147 X |
| 4,718,355 | 1/1988 | Houghton | 108/147 |
| 4,747,353 | 5/1988 | Watt | 108/147 X |
| 5,285,992 | 2/1994 | Brown | 108/147 X |

*Primary Examiner*—Jose V. Chen
*Attorney, Agent, or Firm*—Jones, Day, Reavis & Pogue

[57] ABSTRACT

A counterbalanced adjustable height load bearing support structure comprises a spring biased arm having a cam surface thereon cooperates with a follower of a vertically movable support assembly supporting a load bearing surface. The cam surface in preferred form is generally concave upwardly and has a profile defined by the expressions $$Rx'=r\cos\gamma+(d-r_r)\cos(\beta+\theta)$$

$$Ry'=r\sin\gamma+(d-r_r)\sin(\beta+\theta)$$

where Rx' and Ry' are a local coordinate system on the cam arm, r represents the distance between the cam surface and the center of rotation of the cam arm, $\gamma$ is the angle of rotation of the r vector with respect to the x' coordinate system, $\theta$ is the angular rotation of the cam arm, $\beta$ is an angle normal to the cam surface at its point of contact with the follower as measured relative to the world coordinate system, d is the distance to the center of curvature of the cam profile and $r_r$ is the radius of the cam follower.

9 Claims, 17 Drawing Sheets

ADJUSTABLE HEIGHT LOAD BEARING SUPPORT STRUCTURE

CROSS REFERENCE TO RELATED APPLICATIONS

This application is a continuation-in-part of commonly owned co-pending U.S. patent application Ser. No. 08/634,592, filed Apr. 18, 1996, and titled "Adjustable Height Load Bearing Support Structure."

BACKGROUND OF THE INVENTION

1. Field of the Invention

The present invention relates generally to a load bearing support which is adjustable in height and, more particularly, to a load bearing member which is counterbalanced in a manner such that it can be adjusted to an equilibrium condition for a specific load placed on it whereby the load may be raised or lowered as though weightless through its entire vertical path of travel.

2. Description of the Prior Art

In many applications it is desirable to support a load of some type such that the load may be conveniently raised or lowered. In the contemporary design of office environments, for example, it has been found desirable to sometimes provide tables or desks having work surfaces which are height adjustable. In fact, increasing numbers of people who work in office environments prefer to alter the height of their desk surfaces from a level at which they can be seated in a chair to a level at which they can work while standing. Such height adjustability allows the worker to vary his or her body position and avoid fatigue associated with being confined to a single posture over an extended period of time.

Increasingly, more and more office workers use computers in the course of their normal duties and have their computers placed on their desks. Particularly if the computer monitor and central processing unit are placed on the desk, these items can add considerable weight to the desk surface. Thus, where the desk surface is height adjustable, it is essential that some means be provided for counterbalancing the desk surface so that the user does not need to exert the considerable force which would be needed to raise the desk work surface and associated equipment.

Many systems are known for counterbalancing height adjustable support structures. Early forms of such systems may be found in the drafting table art wherein it is often desirable to have a height adjustable drawing surface. Drafting tables are known, for example, which use forms of parallelogram linkage mechanisms or cable and pulley arrangements and wherein extension springs are used to counterbalance the work surface. However, these arrangements are typically not adjustable in any way to compensate for added weight placed on the work surface. Hence, they are generally unsuitable for use in a height adjustable desk capable of supporting the added weight of a computer or other office equipment. Moreover, they would not provide for counterbalanced work surface support over the full range of vertical adjustment of the surface because the force of the counterbalancing springs changes significantly as the springs are extended.

Attempts have been made to design height adjustable load support members which are counterbalanced in a manner as to also be adjustable to balance differing loads placed on the support surface. One such example of an adjustable load supporting device is disclosed in Holmquist, U.S. Pat. No. 5,236,171, issued Aug. 17, 1993. In that patent, a linkage system is disclosed which is connected to a gas spring. The spring has its opposed ends adjustable along linkage members to exert greater or lesser force on a work surface support member thereby compensating for the load on the associated support surface. However, a disadvantage of that device is that both ends of the spring must be adjusted to compensate for different loads. Moreover, in practice, two such gas springs must be employed, one for each side of the support surface. Thus, when this device is used as a height adjustable desk for example, four separate adjustments must be made if greater or lesser load is placed on the work surface and the load is to be effectively counterbalanced. Moreover, it is not self explanatory how such four adjustments should be made for any given load condition. Thus, as a practical matter, this arrangement is undesirable for use as a consumer product in which relative simplicity of operation is preferred.

In co-pending application Ser. No. 08/634,592, a height adjustable load bearing support structure is provided which may be used as a table or desk. The structure, as will be described hereinafter in detail, includes two extendable vertical support assemblies for supporting a work surface for vertical movement relative to a base frame. The base frame includes two rigid vertical tube members connected by a cross brace. Each vertical support assembly includes a roller which rolls freely on an inside surface of one of the vertical tube members. A second roller of each support assembly is engaged by a distal end of a spring biased pivotable arm. The distal ends of the arms are provided with cam surfaces for engaging the second rollers. The cam surfaces are designed to effectively change the moment arms of the pivotable arms to compensate for the varying forces of the biasing springs as the vertical support assemblies and associated work surface is raised or lowered. The tension on the biasing springs may be adjusted to compensate for loads placed on the support surface. Thus, the load may be effectively counterbalanced throughout its complete path of vertical travel. The user may thereby adjust the support surface between a low position, such as that of a standard desk top, to an elevated position without manual exertion.

In the aforesaid construction, the configuration of the cam surfaces of the pivotable arms is critical to the even counterbalancing of the vertical support assemblies such that the work surface and associated load may be easily raised or lowered by the user without excessive manual exertion. Ideally, the cam surfaces should be configured such that the resultant upward force imparted by the arms to the support assemblies is constant throughout the vertical travel of the support assemblies. To accomplish this, consideration must be given not only to the changing spring force but also to the lateral forces exerted by the rollers of the vertical support assemblies against the vertical tube members.

Accordingly, it is desirable to provide an improved counterbalancing mechanism for a height adjustable load bearing support structure wherein an upward force on a support surface is substantially constant throughout the vertical movement of the support surface. In particular, it is desirable to provide a height adjustable load bearing support structure utilizing spring biased pivotable arms to counterbalance vertical support assemblies wherein the arms exert substantially a constant component of vertical force on the support assemblies throughout the range of vertical support assembly movement.

Further, it is desirable to provide such pivotable arms with cam surfaces cooperation with the vertical support assemblies wherein the cam surfaces are configured to take into account both vertical and lateral components of force on the support assemblies.

SUMMARY OF THE INVENTION

The present invention is an improvement in counterbalanced adjustable height load bearing support structures wherein a spring biased arm having a cam surface thereon cooperates with a follower of a vertically movable support assembly supporting a load bearing surface. The cam surface in preferred form is generally concave upwardly and has a profile defined by the expressions $$Rx'=r\cos\gamma+(d-r_r)\cos(\beta+\theta)$$

$$Ry'=r\sin\gamma+(d-r_r)\sin(\beta+\theta)$$

where Rx' and Ry' are a local coordinate system on the cam arm, r represents the distance between the cam surface and the center of rotation of the cam arm, $\gamma$ is the angle of rotation of the r vector with respect to the x' coordinate system, $\theta$ is the angular rotation of the cam arm, $\beta$ is an angle normal to the cam surface at its point of contact with the follower as measured relative to the world coordinate system, d is the distance to the center of curvature of the cam profile and $r_r$ is the radius of the cam follower.

BRIEF DESCRIPTION OF THE DRAWINGS

The foregoing and other novel features and advantages of the invention will be better understood upon a reading of the following detailed description taken in conjunction with the accompanying drawings in which.

DETAILED DESCRIPTION OF THE PREFERRED EMBODIMENTS

Although the present invention will be described hereinafter in the context of an adjustable height table for office use, it will be appreciated that the invention is equally applicable to load bearing structures of many different types useable in a variety of different applications.

Figure 1:
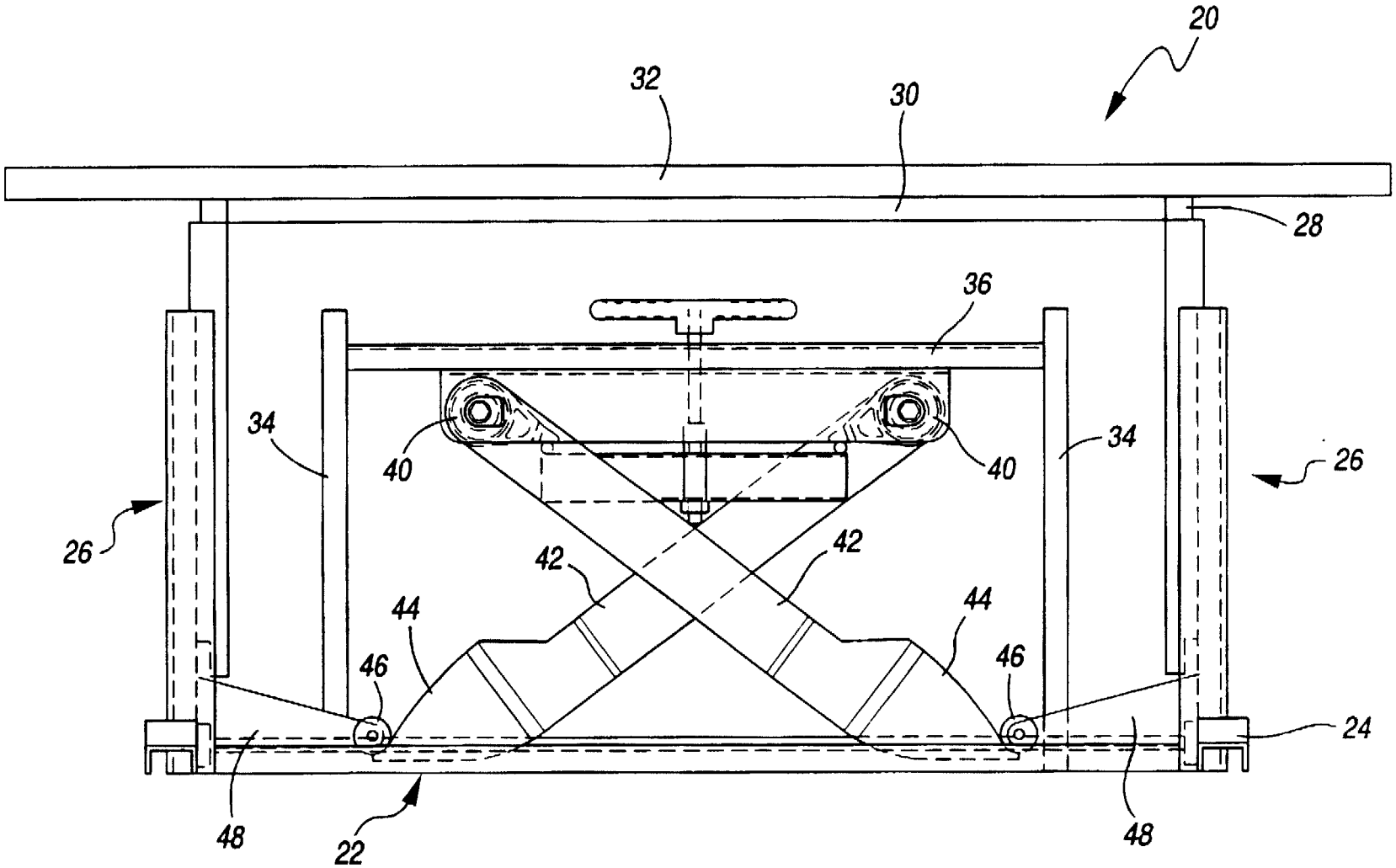
FIG. 1 is a front elevational view of a first embodiment of a table constructed in accordance with the principles of the invention.
Figure 2:
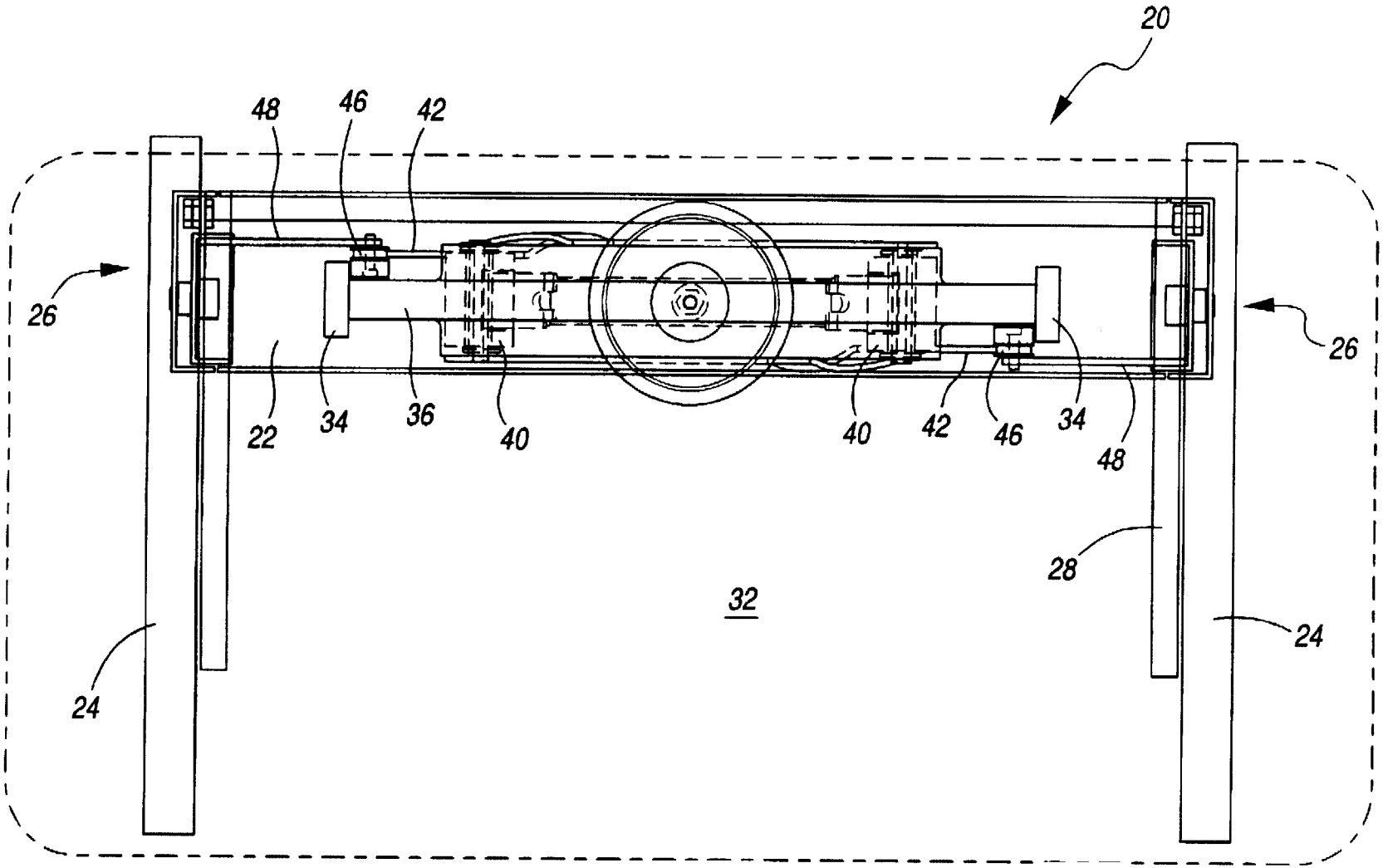
FIG. 2 is a top plan view thereof.
Figure 3:
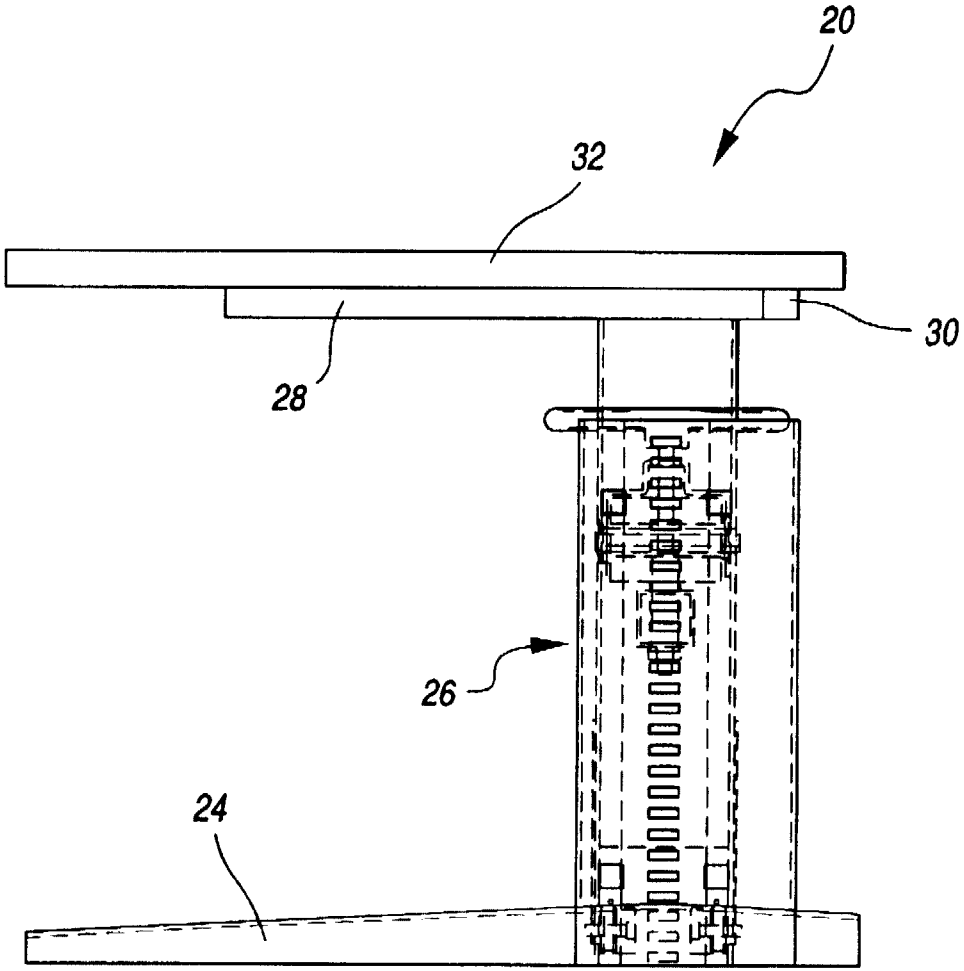
FIG. 3 is a right side elevational view thereof.

Referring now to the drawings, and initially to FIGS. 1–3, an adjustable height table is designated generally by the reference numeral 20 and includes a base frame 22 including a pair of opposed legs 24. Supported on the frame 22 are a pair of extendable upright support assemblies 26 which will be described in detail hereinafter. At the upper ends of each assembly 26 a forwardly extending arm 28 is provided. The arms 28 are connected by a cross brace 30 which together serve to support a suitable work surface 32.

Positioned beneath the work surface 32 and attached to the base frame 22 as by welding is a support structure comprising two vertical tubes 34 and a connecting cross brace 36. The cross brace 36 supports a pair of elastomer torsion springs 40 each connected to a generally elongate arm 42 which extends diagonally beneath the work surface 32. The distal end of each arm is provided with a cam surface 44 on which a roller 46 rides. The rollers 46 are journaled for free rotation on brackets 48 connected to the upright assemblies 26 as will be described hereinafter. The rollers 46 have dual roller surfaces, one of which rides on the cam surface 44 and the other of which rides on the vertical tubes 34. In this way the vertical tubes 34 resist lateral forces placed on the brackets 48 as the rollers 46 ride on the cam surfaces 44.

Figure 4:
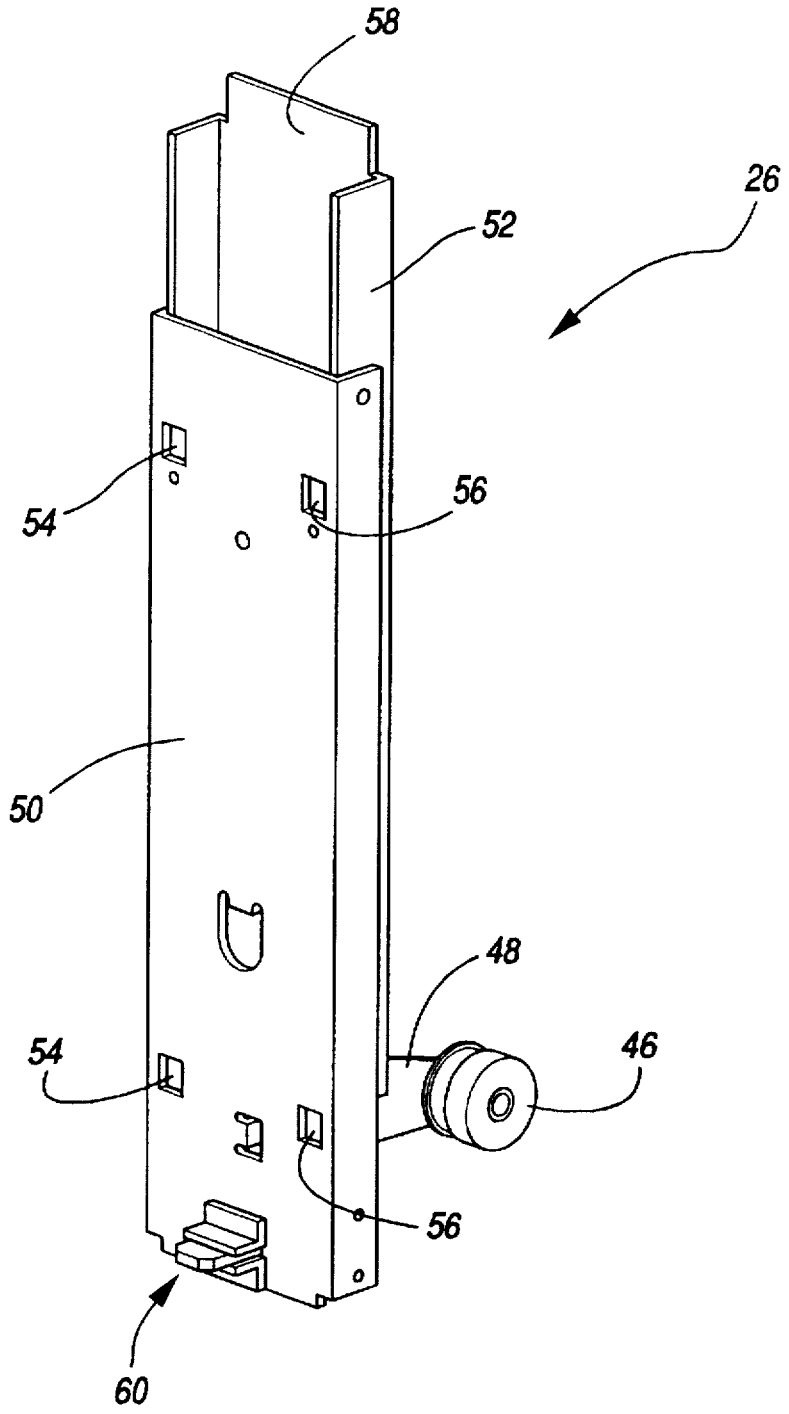
FIG. 4 is a perspective view of work surface support assembly constructed according to the principles of the invention.
Figure 5:
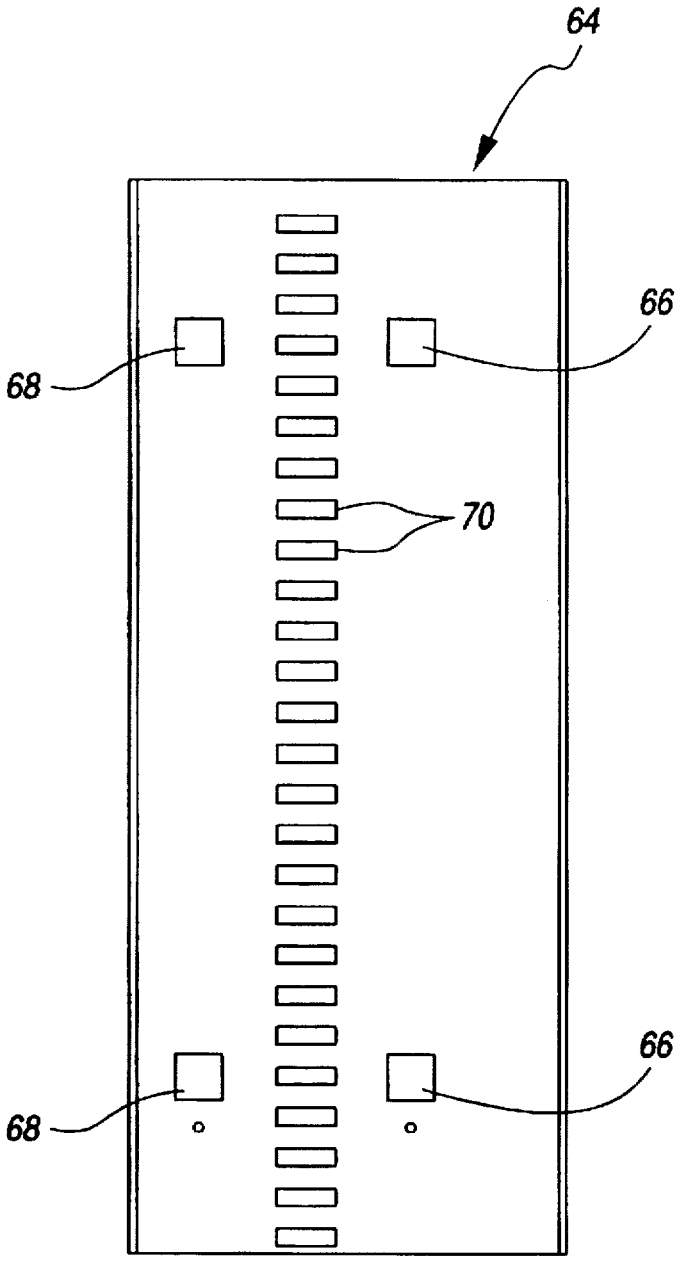
FIG. 5 is a front view of a channel member for cooperation with the work surface support assembly.
Figure 6:
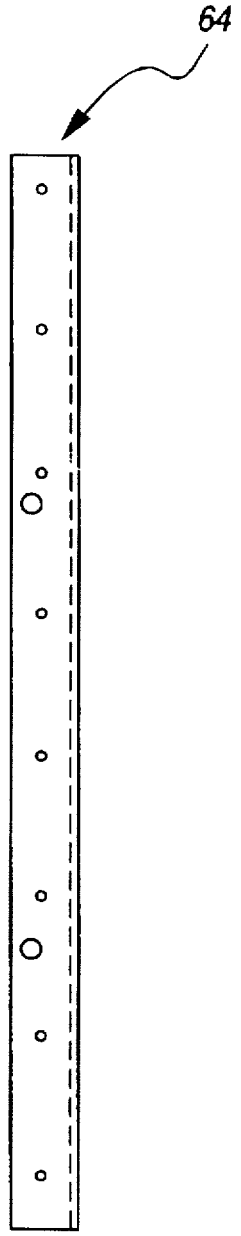
FIG. 6 is a side view thereof.

The construction of the upright assemblies 26 can be seen in FIG. 4. Each assembly 26 includes two C-shaped channel members 50 and 52 preferably bolted together with member 52 slidingly received within member 50. This sliding configuration allows the assembly 26 to be manually adjusted for differing ultimate heights of the work surface 32. The roller bracket 48 is preferably welded to the inside of the channel member 50. The channel member 50 is provided with pairs of spaced rectangular apertures 54 and 56 for receiving lanced tabs of ball bearing slide assemblies as will be hereinafter described. The upper end of member 52 is provided with a flange 58 to which each arm 28 is welded. A latch assembly 60 as will be described is provided at the lower end of the member 50. The assemblies 26 further include a generally C-shaped channel member 64 which is preferably welded to legs 24 of the base frame 22. As best seen in FIGS. 5 and 6, these channel members 64 include pairs of spaced rectangular apertures 66 and 68 and a series of aligned closely spaced slots 70.

Figure 7:
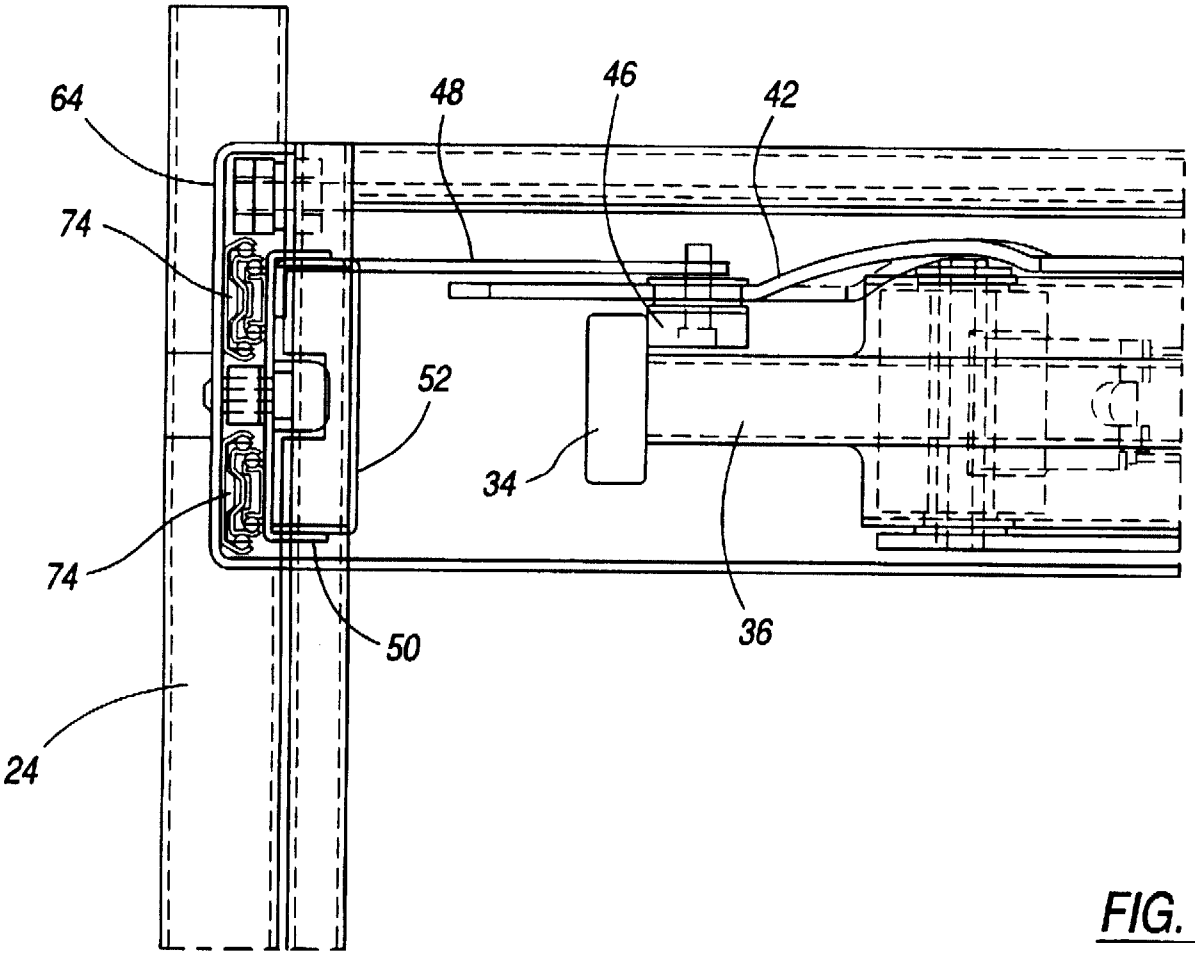
FIG. 7 is a partial top view illustrating the component parts of the work surface support assembly.
Figure 8:
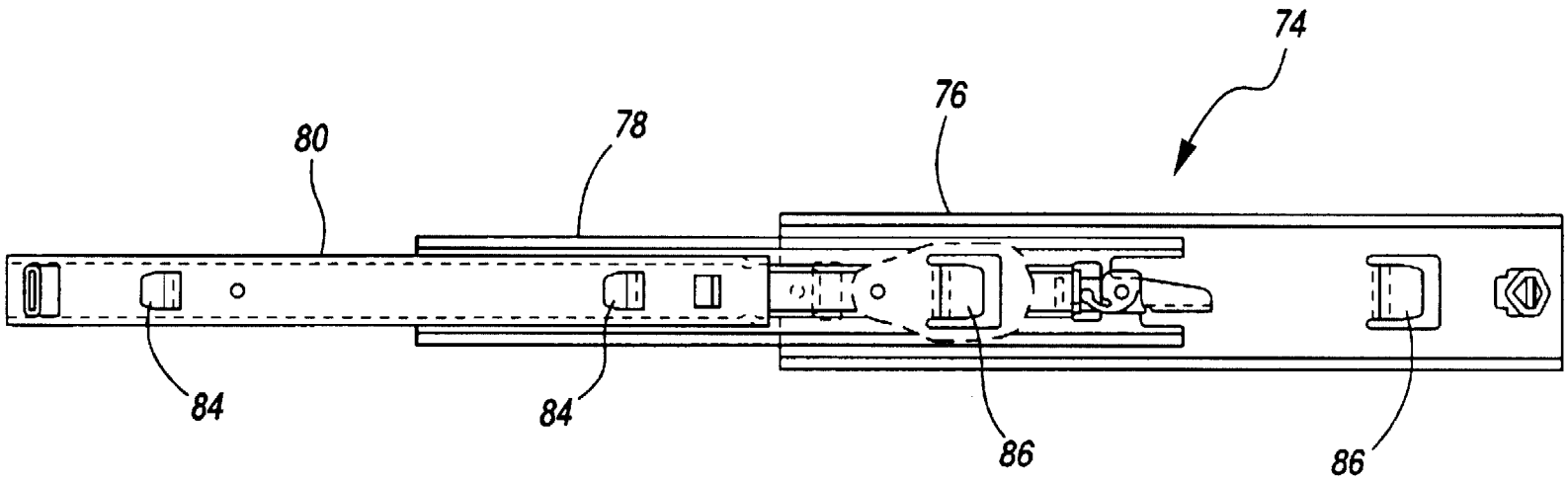
FIG. 8 is a plan view of a slide assembly for supporting the work surface of the table.
Figure 9:
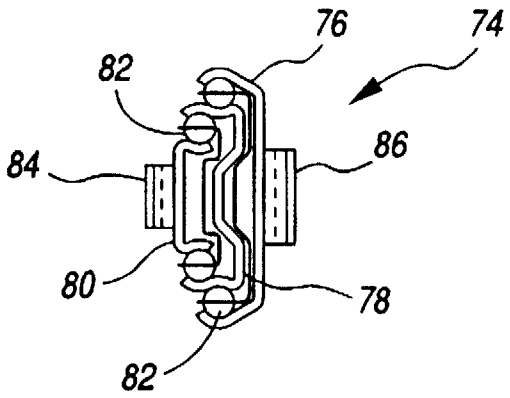
FIG. 9 is an end view thereof.

The assembled condition of the uprights 26 is best seen in the top view of FIG. 7 wherein a pair of ball bearing slide assemblies 74 are disposed between the channel member 64 and the member 50. Each slide assembly 74 may be of a type well known in the art for use in cabinetry, and best seen in FIGS. 8 and 9, consisting of three track members 76, 78 and 80 which freely slide on suitable ball bearings 82. The innermost track 80 is provided with lanced tabs 84 which engage the aforementioned apertures 54 and 56 of the channel member 50. Likewise, the outermost track 76 is provided with lanced tabs 86 which engage the apertures 66 and 68 of the channel members 64. By this arrangement, pairs of slide assemblies 74 may be readily installed in the upright assemblies 26 and secured in proper place by suitable sheet metal screws.

Figure 10:
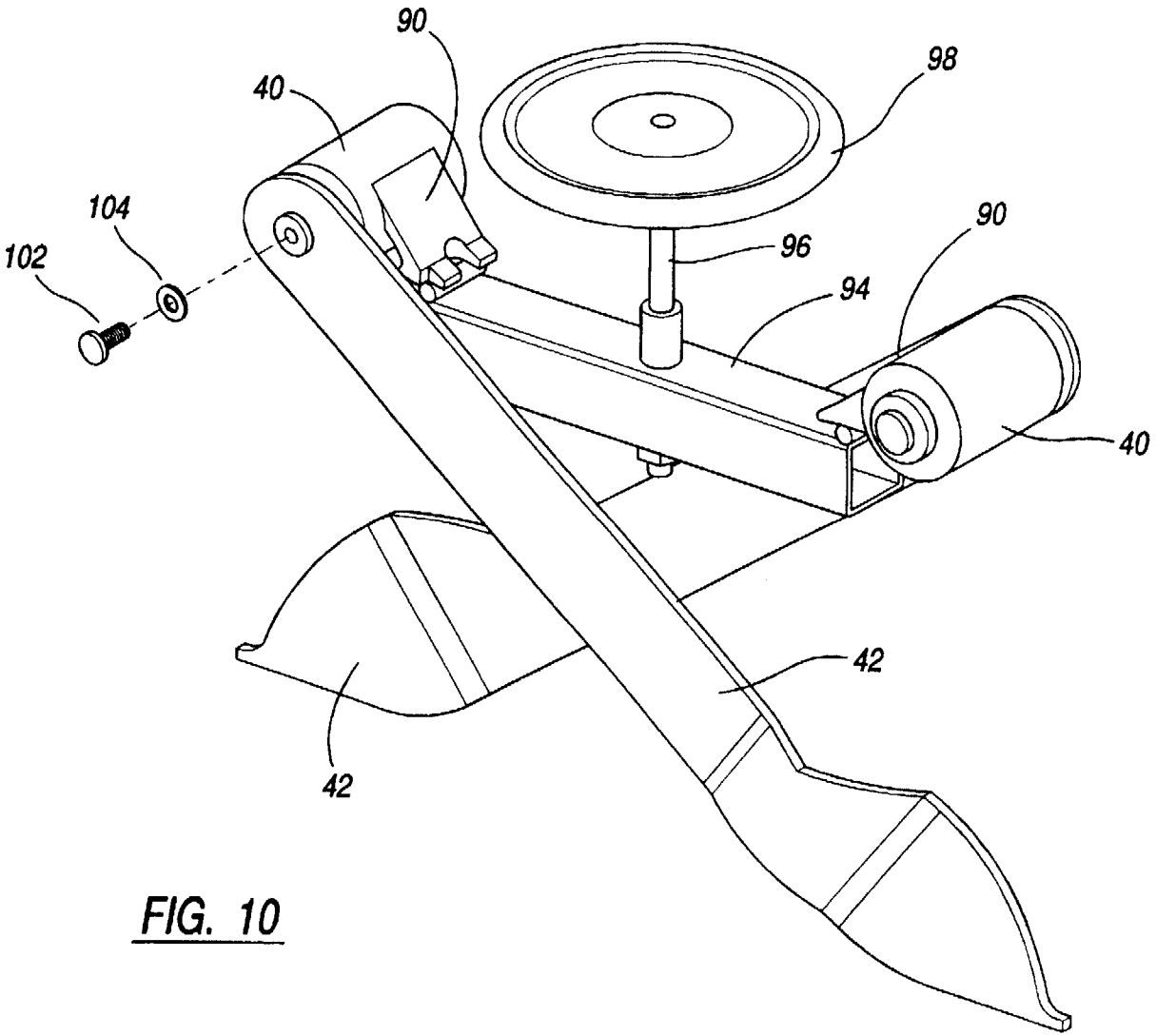
FIG. 10 is a perspective view illustrating the counterbalancing mechanism of the table.
Figure 11:
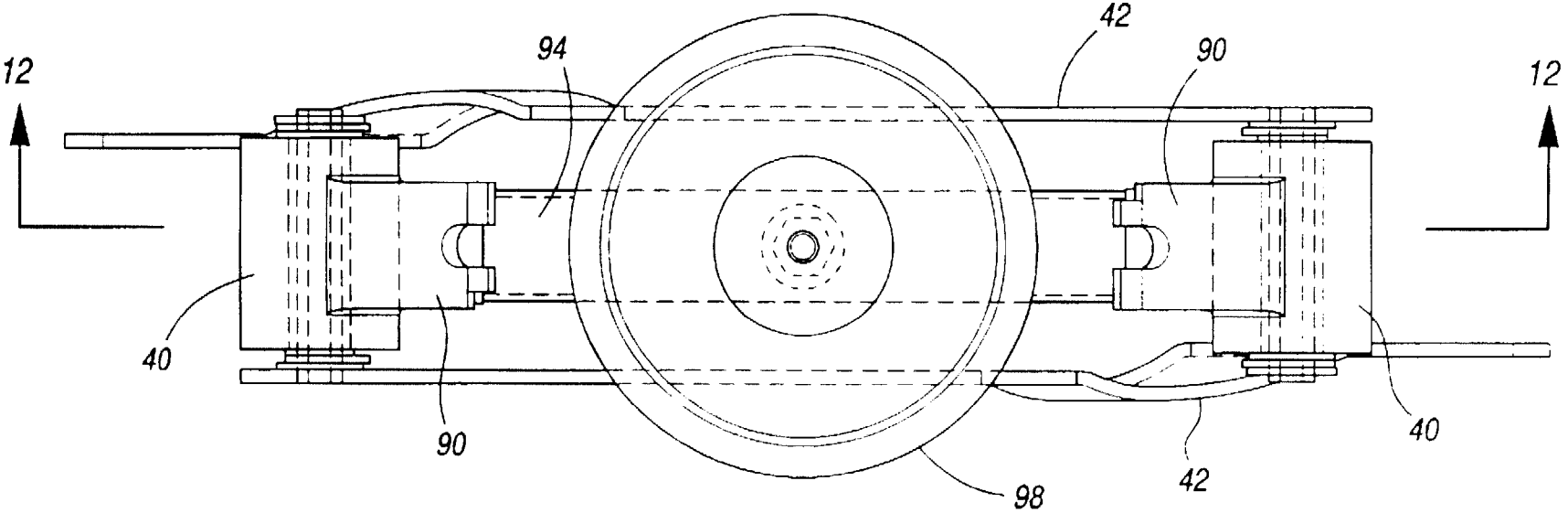
FIG. 11 is a top plan view of the counterbalancing mechanism.
Figure 12:
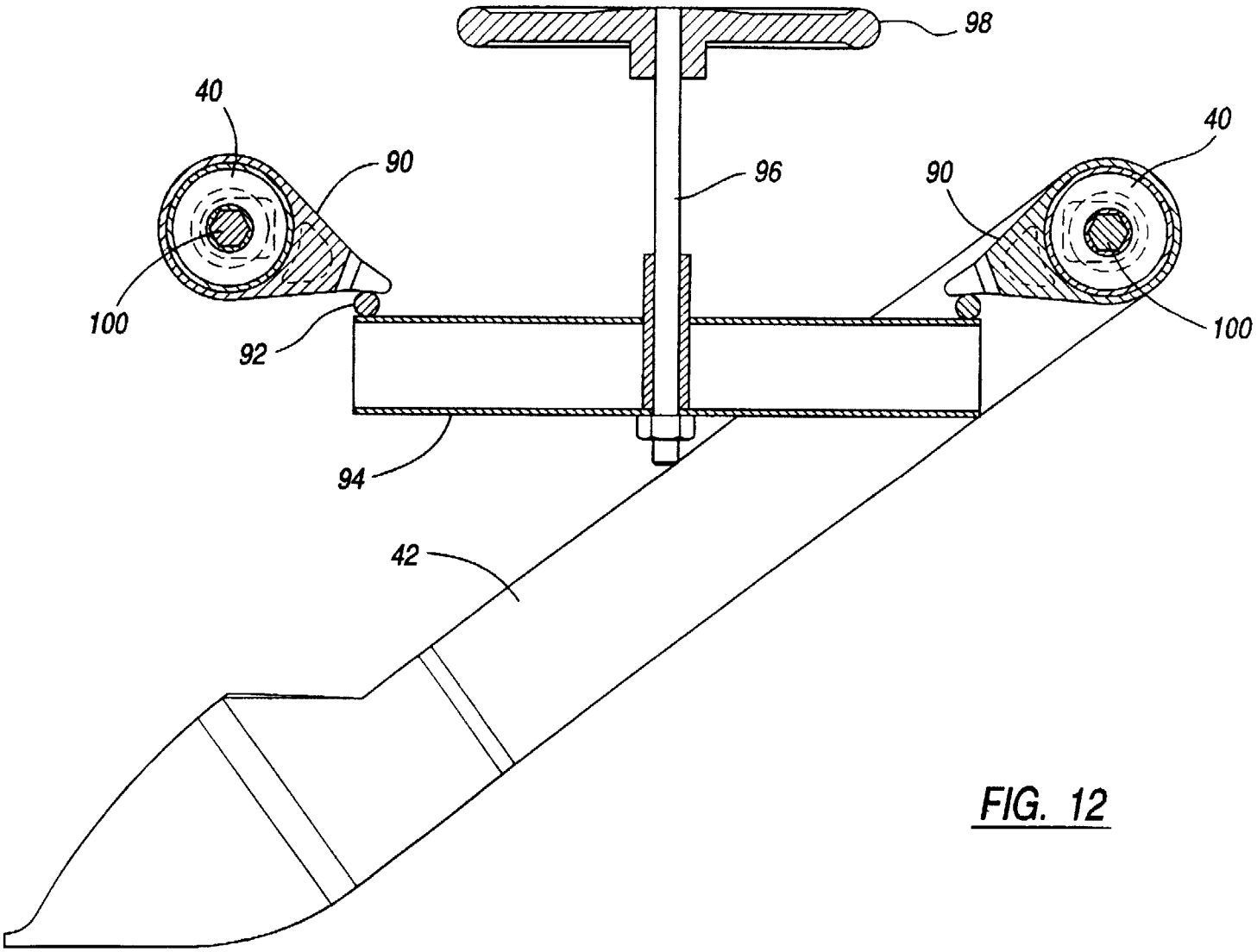
FIG. 12 is a cross-sectional view taken substantially along the line 12—12 of FIG. 11.
Figure 13:
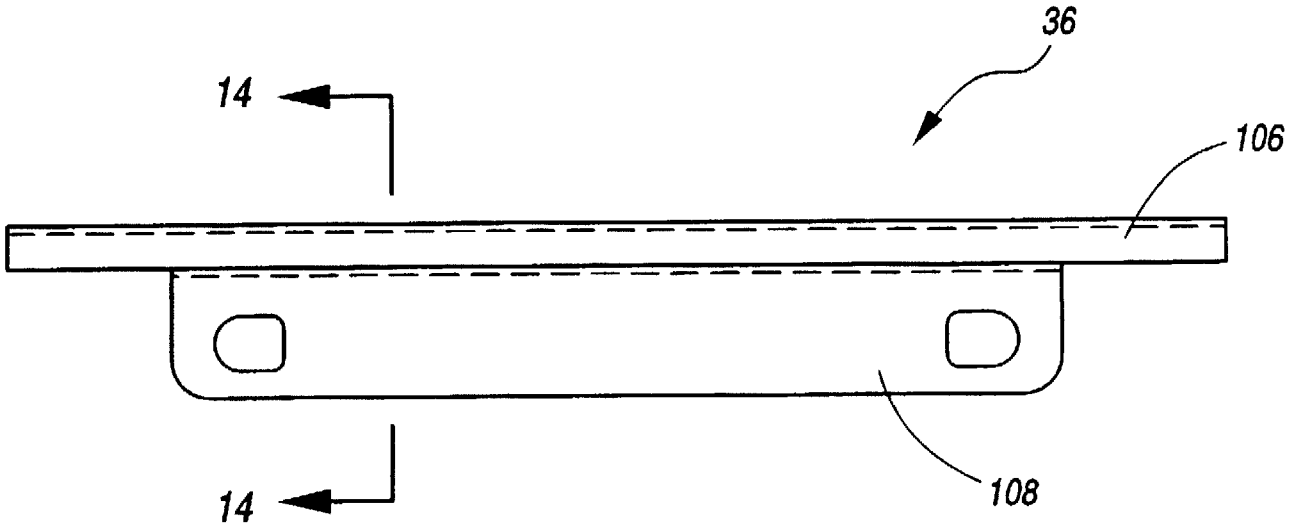
FIG. 13 is a side view of a support channel for supporting the counterbalancing mechanism.
Figure 14:
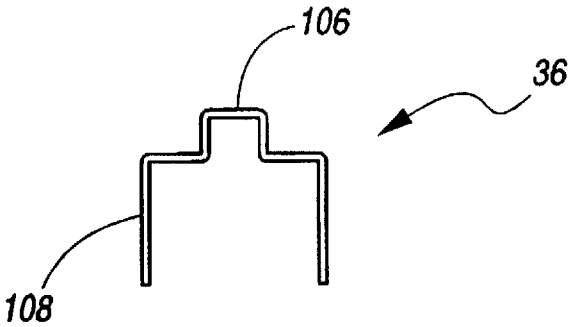
FIG. 14 is a cross-sectional view taken substantially along the line 12—12 of FIG. 13.

The function of the arms 42 in counterbalancing the work surface 32 can best be seen in FIGS. 10, 11 and 12. The elastomeric springs 40 are provided with arms 90 extending from one side thereof which are each engaged by bearing rods 92 welded to a cross tube 94. A threaded shaft 96 connected to a hand wheel 98 may be manually turned to increase or decrease the tension of the two spring 40 thereby altering the spring force on the counterbalancing arms 42. The connection between the arms 42 and springs 40 is preferably made by hexagonal cross-section shafts 100 to which the arms 42 are fastened by suitable screws 102 and associated washers 104. The cross brace 36 which supports the springs 40 and the associated tension adjustment members is shown in FIGS. 13 and 14 and can be seen to be an integrally stamped and formed member having a first narrow channel portion 106 and a wide lower channel portion 108.

Figure 17:
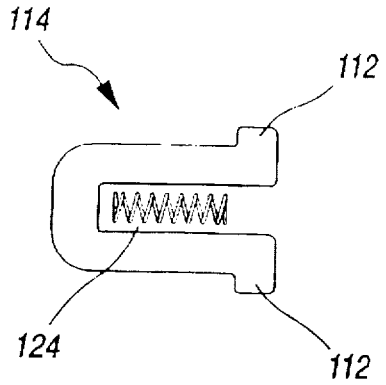
FIG. 17 is a plan view of a latch bar as used in the latch mechanism.
Figure 16:
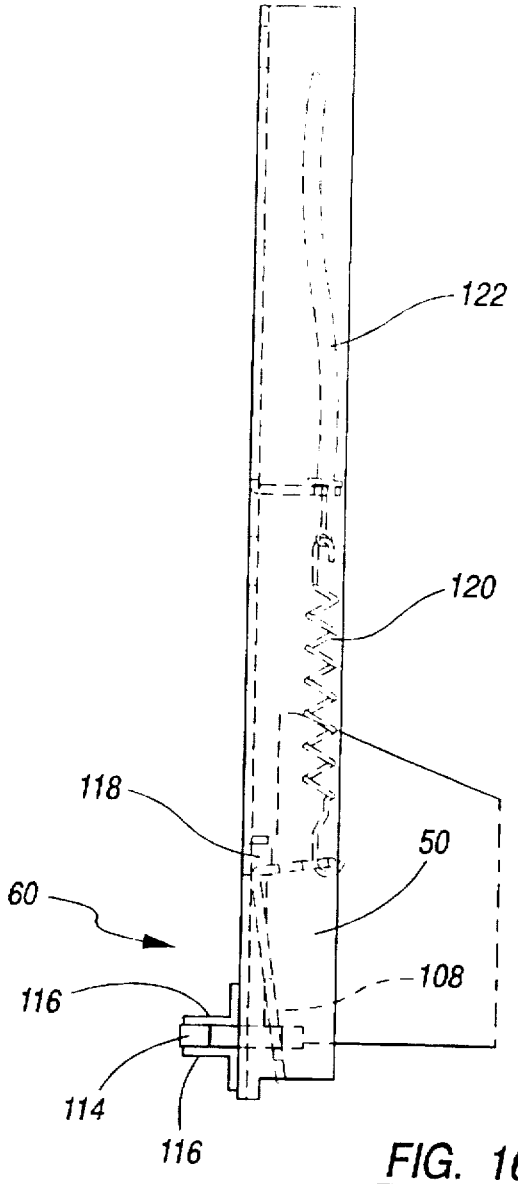
FIG. 16 is a side view thereof.
Figure 15:
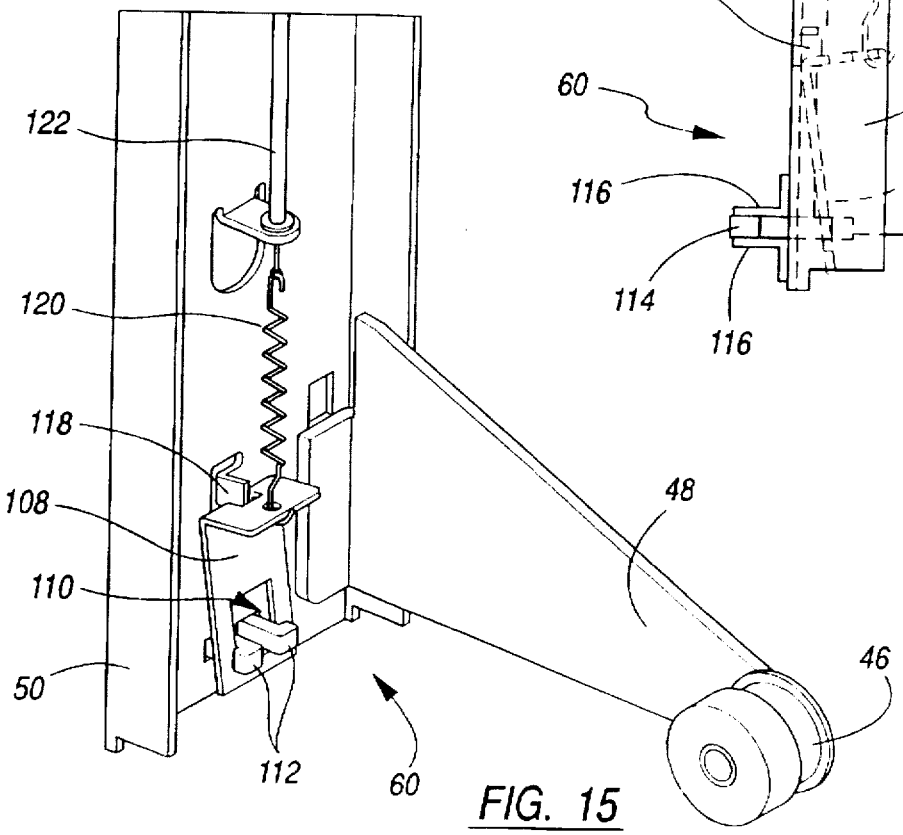
FIG. 15 is a partial perspective view illustrating the latch mechanism of the present invention.

An important feature of the invention is the latch assembly 60 best illustrated in FIGS. 15–17. The latch assembly 60 includes an L-shaped bracket 108 having an aperture 110 which engages ears 112 of a latch bar 114. The ears 112 each project through an aperture of the channel member 50 and the bar 114 is guided by a pair of L-shaped supports 116 extending from the outwardly directed side of the channel member 50. A tab 118 struck from the channel member 50 is received by a slot formed in the bracket 108 permitting the bracket 108 to rock under the action of a suitable spring 120 and associated cable 122. The latch bar 114 is normally biased outwardly by a spring 124 which bears against the channel member 50. When the cable is relaxed, the latch bar 114 will project outwardly of the supports 116 a sufficient distance to engage a selected slot 70 of the channel member 64. The work surface 32 may thereby be effectively locked in a plurality of vertical positions relative to the floor of the surrounding room.

Figure 18:
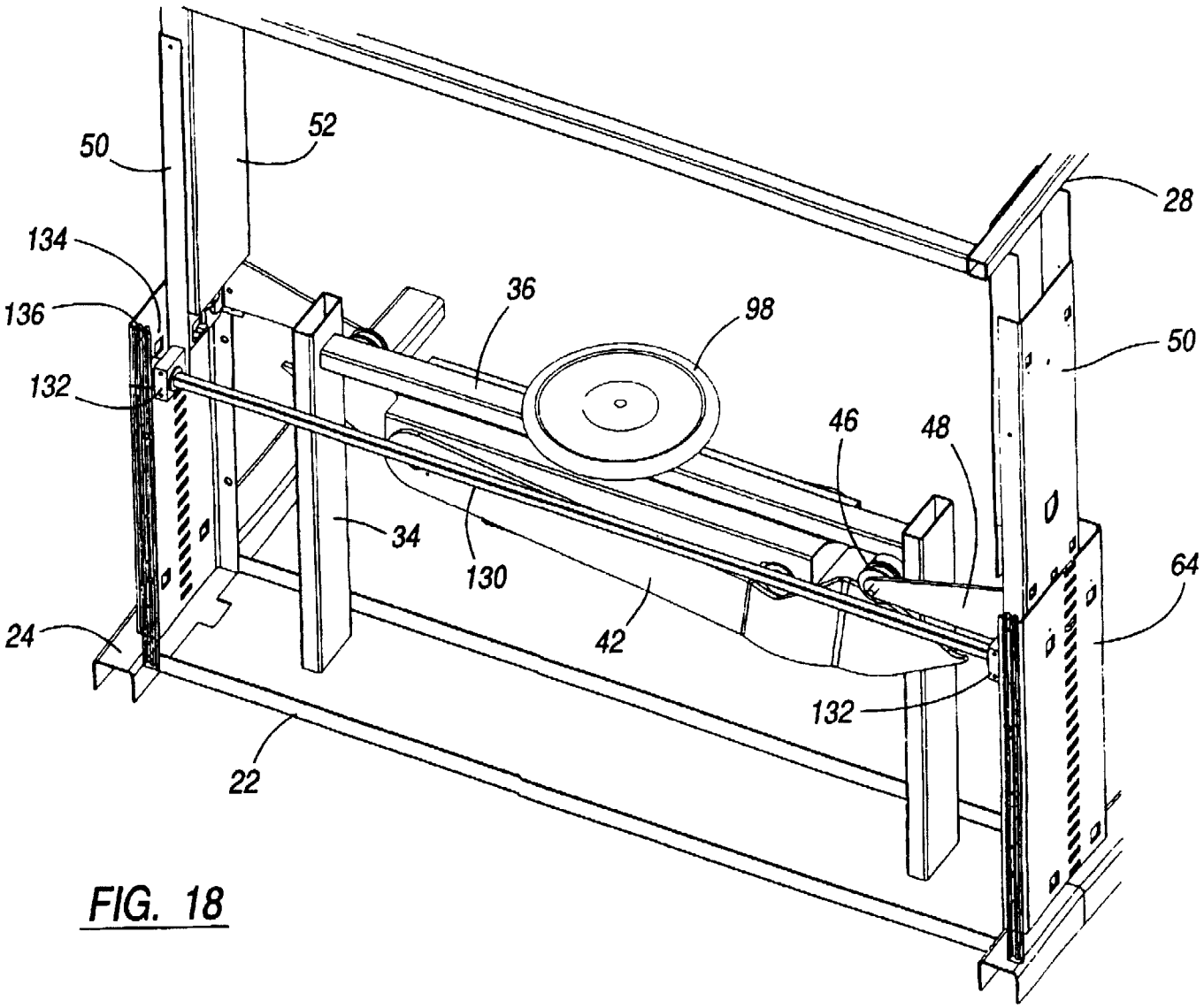
FIG. 18 is a rear perspective view of a table in accordance with the invention illustrating the work surface elevated to its uppermost position.

Operation of the table 20 can best be seen in the perspective view of FIG. 18. In this view the table 20 is shown in a fully upwardly extended position. The slide assemblies 74 are removed for clarity. In this position, the arms 42 have biased the support assemblies 26 upwardly directed force on the brackets 48. The rollers 46 have followed the cam surfaces 44 of the arms 42 to a position closer to the pivot shafts 100 of the arms 42. Thus, as the torsion springs 40 unwind and exert lesser force on the arms 42 the effective moment arm of each arm 42 is reduced causing the resultant force on the brackets 48 to be equalized throughout the range of vertical travel of the work surface 32. As weight is placed on the work surface 32, such as computer equipment or the like, the spring 40 force may be increased by turning the hand wheel 98 and tensioning the springs 40 to any desired condition. Thereby, the work surface 32 may be counterbalanced for a variety of loads placed thereon such that it can be raised or lowered as desired by the table 20 user with relative ease once the springs 40 are preadjusted for the weight of the load.

It can be appreciated that loads placed on the work surface 32 may be off-center of the work surface. Thus, to accommodate uneven loading of the work surface 32 and permit both support assemblies 26 to raise and lower at the same rate and without binding a system may be employed such as rack and pinion gearing to synchronize movement of the support assemblies 26. As shown in FIG. 18 such a system may include a shaft 130 supported on the channels 50 by suitable bearings 132 and having spur gears 134 which engage vertical gear racks 136 mounted to the channels 64. Such a system will assure that both support assemblies 26 move evenly at the same rate despite off-center loading.

A suitable elastomeric torsion spring 40 which performs well with the table 20 is available from Lord Corporation of Erie, Pa. However, a steel torsion spring will perform equally well. It can also be appreciated that the cable system 122 used to operate the latch 60 may be constructed to be either hand operated or foot operated. In one form of the invention the cable 122 from both sides of the table may be routed to a Y-connection beneath the work surface 32 as to be hand-operated by a suitable know (not shown).

An advantage of the invention is that the table 20 may be assembled with differing ranges of vertical height capability depending on the preferences of the user. This is possible simply by bolting the channel members 50 and 52 together at differing telescoping position. With the slide assembly 74 illustrated, the table may have a work surface height adjustment range from as low as 26 inches to 44 inches to greater than 30 inches to 48 inches. It is also important that the entire counterbalancing mechanism is located underneath the work surface 32 and toward the rear of the table 20. This distinguishes over tables having counterbalancing mechanisms located on the sides of the table which must be shrouded to avoid safety hazards and thus have an awkward appearance. The mechanism of the present table 20 may be shrouded to appear like a modesty panel which is a common feature of many expensive looking tables and desks.

Figure 19:
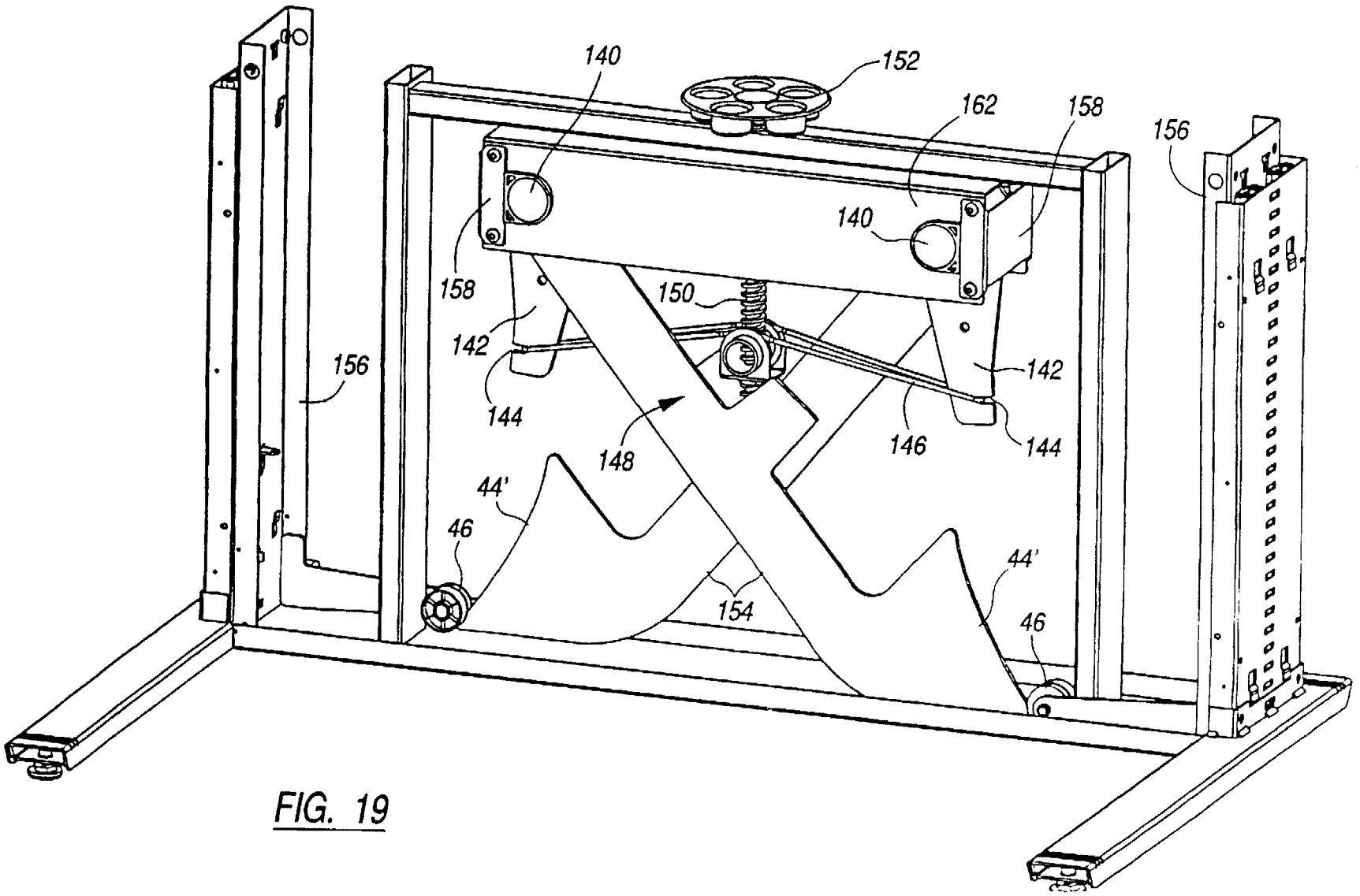
FIG. 19 is a front perspective view of a second embodiment of a table constructed in accordance with the principles of the present invention illustrating a modified spring pretensioning system over the system disclosed in the previous drawing figures and showing the springs as pretensioned to a first counterbalancing force.

Turning now to FIG. 19, a front perspective view is shown of an adjustable height load bearing support structure constructed in accordance with another embodiment of the present invention illustrating a modified spring tensioning system over the system shown in FIGS. 10, 11 and 12. In this tensioning system, torsion springs 140 preferably of an elastomeric type are provided with downwardly extending arms 142 having slots 144 for receiving a transverse cable 146. The cable 146 runs between the two arms 142 and across a cable tensioning mechanism designated generally as 148. A screw shaft 150 operated by a hand wheel 152 is threaded to the mechanism 148 and draws the cable 146 up or down at its center placing greater or lesser force, respectively, on the arms 142. In this manner, the springs 140 can be pretensioned through a range of tension force on pivotable arms 154 which, in turn, pretensions the upward forces on support members 156. FIG. 19 shows the tensioning system in a somewhat relaxed condition while FIG. 20 shows the system in a relatively tightly tensioned condition.

Figure 21:
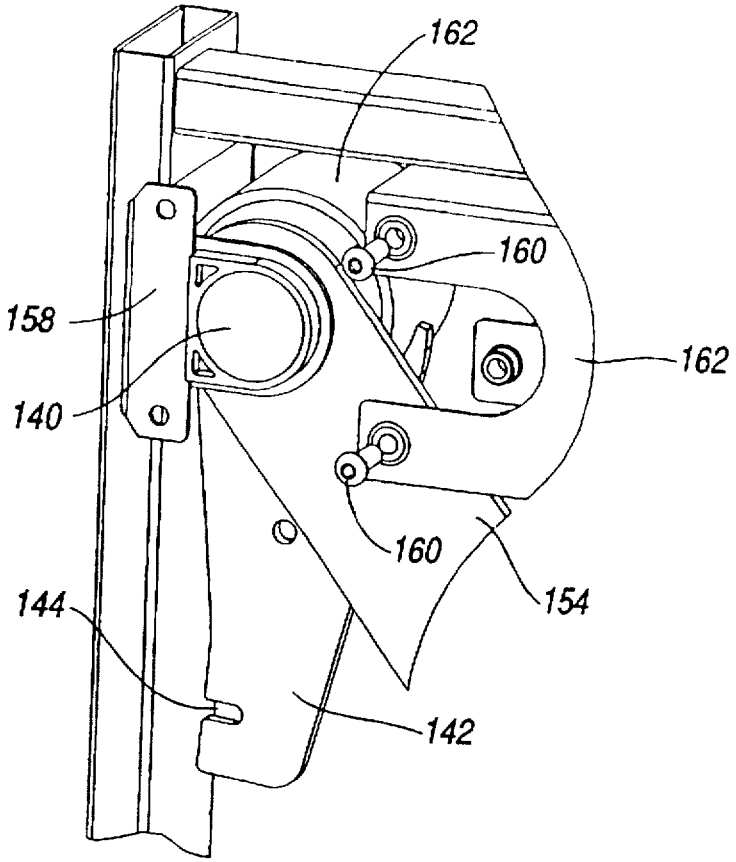
FIG. 21 is a partial exploded perspective view of the spring mounting construction.

FIG. 21 shows the details of the spring 140 mounting structure wherein the spring is supported by a suitable bracket 158 fastened by screws 160 to a main cross housing 162. The arms 142 may be secured as by welding to outer housings 162 of the springs 40.

Figure 22:
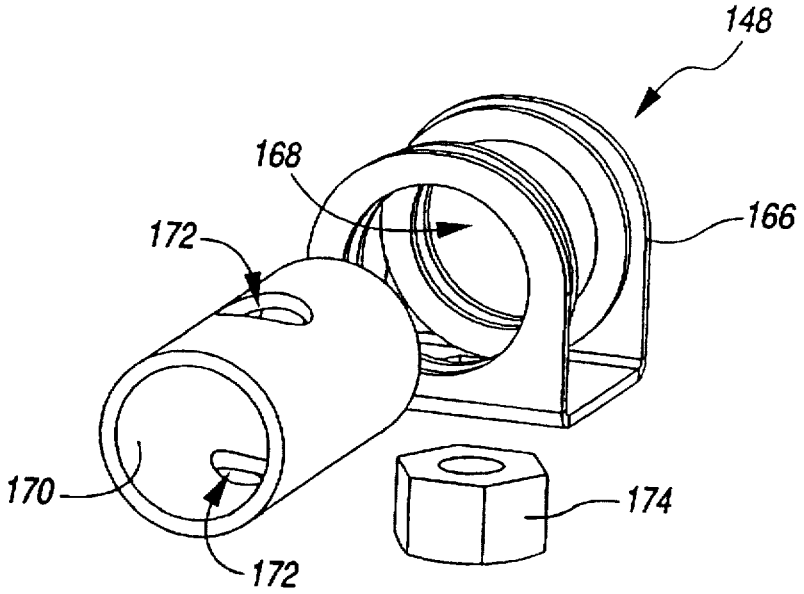
FIG. 22 is an exploded perspective view of a portion of the spring pretensioning assembly.

FIG. 22 illustrates the principal elements of the tensioning mechanism 148 which include a generally U-shaped bracket 166 having circular openings 168 for slidingly receiving a bushing 170. The bushing 170 is provided with a pair of aligned apertures 172 for slidingly receiving the screw shaft 150 which, in turn, is threaded into a nut 174 secured to the bracket 166.

Figure 20:
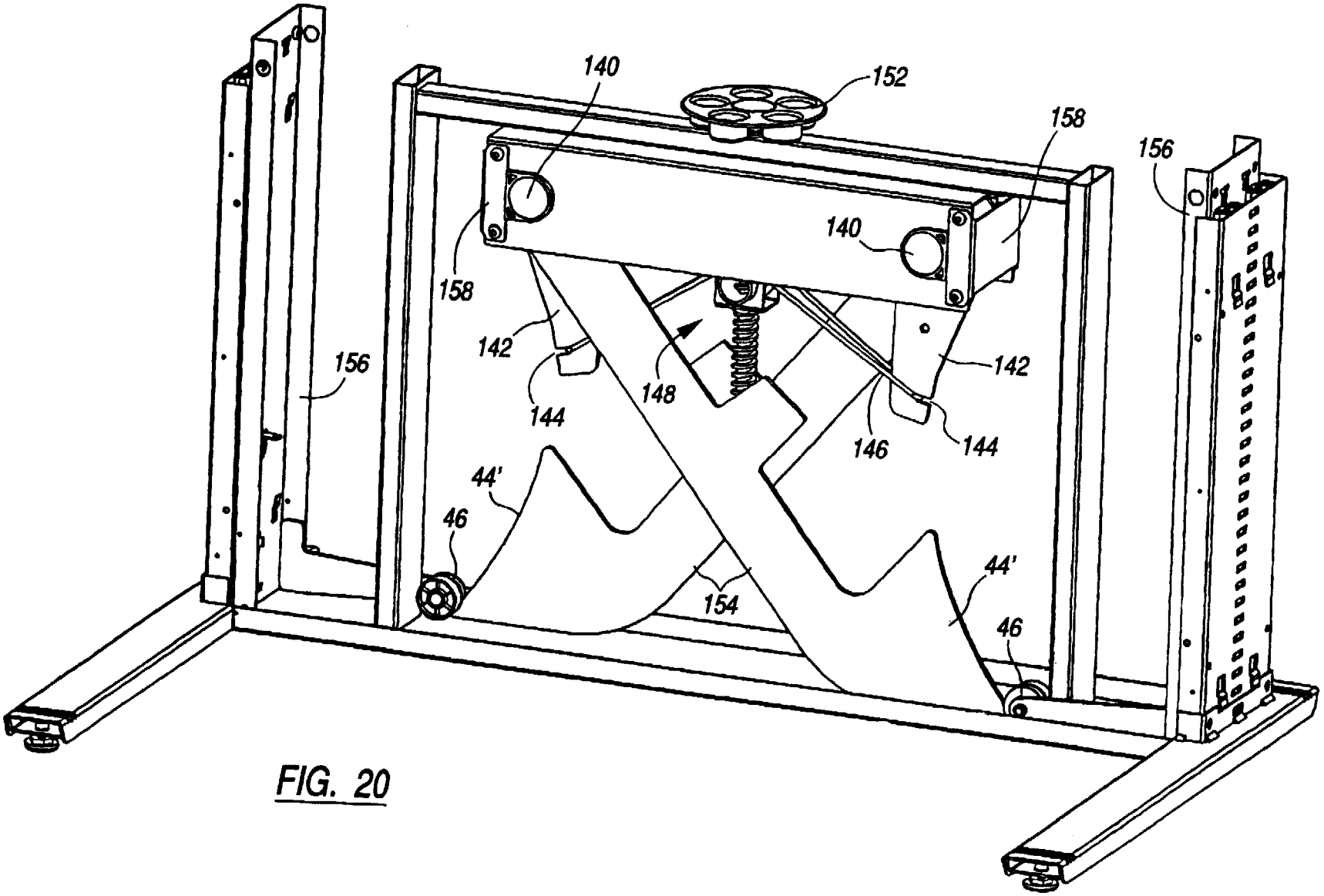
FIG. 20 is a front perspective view of the modified support structure illustrating the springs as pretensioned to a second counterbalancing force.
Figure 23:
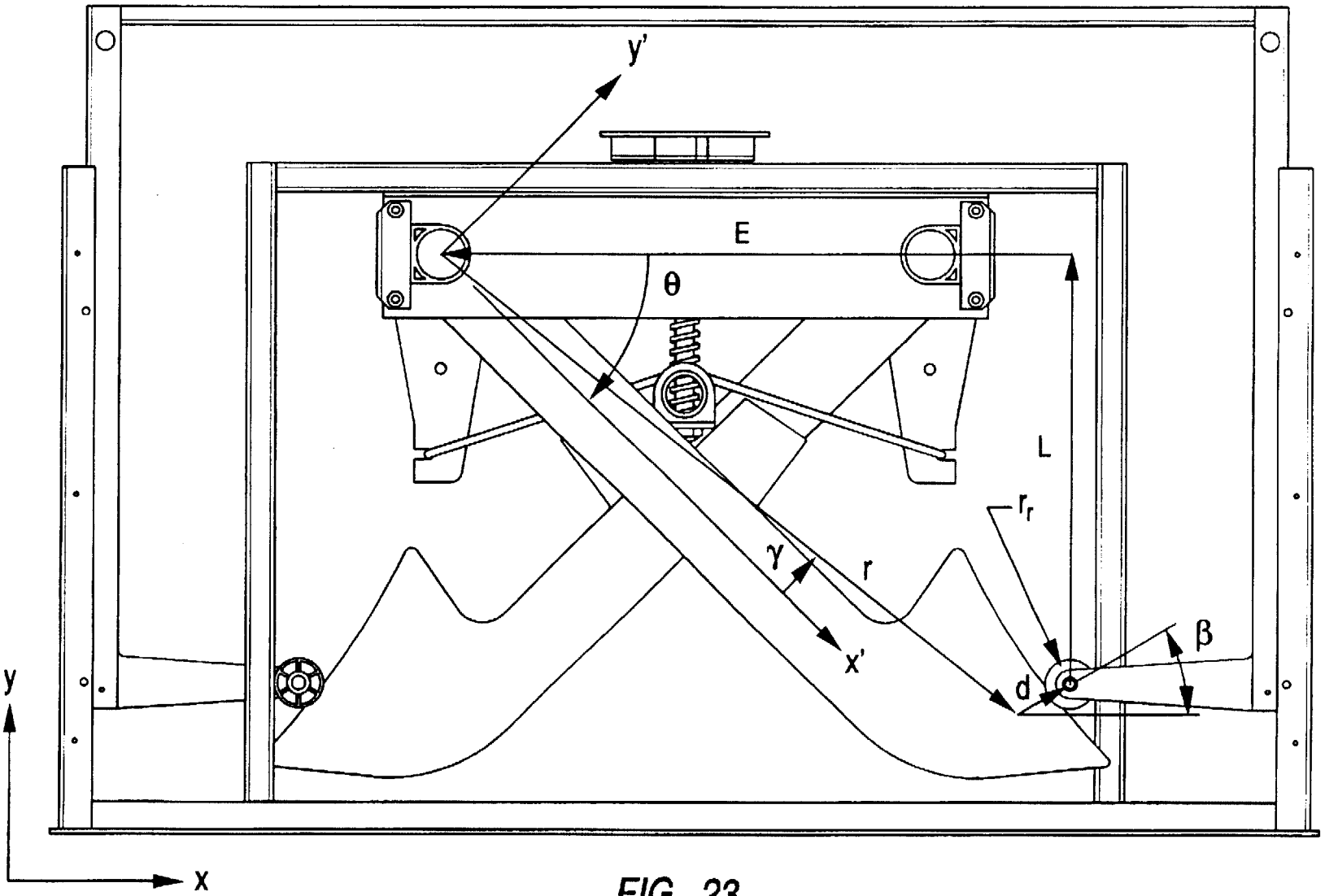
FIG. 23 is a force vector diagram of the adjustable height load support structure of FIGS. 19 and 20.

Referring now to FIG. 23, a force vector diagram is shown of the support structure illustrated in FIGS. 19 and 20. In accordance with the invention, the diagram may be used to analyze a vector loop equation which, in turn, may be used to derive an optimal profile of cam surfaces 44'. Such optimal curvature takes into account both vertical and horizontal components of force acting on the cam followers 46 under influence of the cam arms 154. An optimal curvature would provide for a uniform upwardly directed force on the cam follower throughout its full vertical range of travel resulting in a counterbalancing effect which would cause raising of the structure support surface to be substantially effortless. The analysis is as follows Vector Loop Equation: $r + d + L + E = 0$ Euler's Form: $re^{-i(\theta-\gamma)} + de^{i\beta} + Le^{i(\pi/2)} + Ee^{i(3\times/2)} = 0$ Scalar Equations:

$$r\cos(\theta-\gamma) + d\cos\beta - E = 0 \quad \text{(eq. 1)}$$

$$-r\sin(\theta-\gamma) + d\sin\beta + L = 0 \quad \text{(eq. 2)}$$

Statics:

$$\Sigma F = 0 = F\sin\beta - W \quad \text{(eq. 3)}$$

$$\Sigma M_o^y = 0 = T(\theta) - Fr\sin(\theta-\gamma+\beta) = 0 \quad \text{(eq. 4)}$$

Combining equations (3) and (4), and substituting equations (1) and (2) yields, $$(T(\theta) - EW)\sin\beta - WL\cos t\beta = 0 \quad \text{(eq. 5)}$$

This results in 3 equations (eq. 1, 2, 5), 5 unknowns (r, γ, d, β, L) and the variable θ. Differentiating equations (1) and (2) twice, produces 4 more equations, $$-r\sin(\theta-\gamma) - d\beta'\sin\beta = 0 \quad \text{(eq. 6)}$$

$$-r\cos(\theta-\gamma) + d\beta'\cos\beta + L' = 0 \quad \text{(eq. 7)}$$

$$-r\cos(\theta-\gamma) - d\beta''\sin\beta - d\beta'^2\cos\beta = 0 \quad \text{(eq. 8)}$$

$$r\sin(\theta-\gamma) + d\beta''\cos\beta = d\beta'^2\sin\beta + L'' = 0 \quad \text{(eq. 9)}$$

This results in 7 equations (eq. 1, 2, 5, 6, 7, 8, 9), 9 unknowns (r, γ, d, β, β', β", L, L', L"). Substituting equations (1) and (2) into equations (6) and (8) eliminates r and γ, $$d(1+\beta')\sin\beta + L = 0 \quad \text{(eq. 10)}$$

$$d(1+\beta')\cos\beta - E + L' = 0 \quad \text{(eq. 11)}$$

$$d(1-\beta'^2)\cos\beta - E - d\beta''\sin\beta = 0 \quad \text{(eq. 12)}$$

$$d(1-\beta'^2)\sin\beta + L + d\beta''\cos\beta + L = 0 \quad \text{(eq. 13)}$$

Substituting equations (10) and (11) into (5) yeilds, $$L' = T/W \quad \text{(eq. 14)}$$

$$L''_1 = T/W \quad \text{(eq. 15)}$$

$$L = \int . T'/W \quad \text{(eq. 16)}$$

AND from equations (10) and (11), $$\beta = \tan^{-1}(-L/(E-L')) \quad \text{(eq. 17)}$$

Differentiating equation (5) yeilds, $$\beta' = \frac{WL'\cos\beta - T'\sin\beta}{WL\sin\beta + (T-EW)\cos\beta} \quad \text{(eq. 18)}$$

Now with β' and equation (10), $$d = \frac{-L}{(1+\beta')\sin\beta} \quad \text{(eq. 19)}$$

From equations (1) and (2), $$r = \{(d\sin\beta + L)^2 + (E - d\cos\beta)^2\}^{1/2} \quad \text{(eq. 20)}$$

$$\gamma = \theta - \tan^{-1}\frac{L + d\sin\beta}{E - d\cos\beta} \quad \text{(eq. 21)}$$

Finally, to find points on the cam face within its local coordinate system (x', y'), $$Rx'\ r\cos\gamma + (d - r_r)\cos(\beta+\theta) \quad \text{(eq. 22)}$$

$$Ry'\ r\sin\gamma + (d - r_r)\sin(\beta+\theta) \quad \text{(eq. 23)}$$

where Rx' and Ry' define coordinates on a local coordinate system on the cam arm, r represents the distance between the cam surface and the center of rotation of the cam arm, γ is the angle of rotation of the r vector with respect to the x' coordinate system, θ is the angular rotation of the cam arm, β is an angle normal to the cam surface at its point of contact with the follower as measured relative to the world coordinate system, d is the distance to the center of curvature of the cam profile and $r_r$ is the radius of the cam follower.

It can now be appreciated that an adjustable height load bearing support structure in accordance with the invention provides a highly effective means for counterbalancing a load placed on a support surface such that the surface may be raised or lowered without manual exertion. Such a structure is particularly suitable to be used as a table or desk wherein the user may have a heavy article such as a computer placed on the work surface yet desires to raise or lower the work surface from time to time. The novel cam profile as heretofore described allows for essentially effortless vertical movement of the support surface under the action of spring biased arm members cooperating with associated vertical support structures.

While the invention has been described in connection with preferred embodiments thereof it will be apparent to those skilled in the art that many changes and modifications may be made without departing from the true spirit and scope of the invention. Accordingly, it is intended by the appended claims to cover all such changes and modifications as come within the true spirit and scope of the invention.

What is claimed is:

1. An adjustable height load bearing support structure comprising:

a base frame;

a generally planar support surface member;

support assembly means configured to support said support surface member for vertical movement relative to said base frame when said base frame is positioned on a horizontal surface;

at least one spring biased arm being pivotable about an axis disposed beneath said support surface member and having a free distal end; and cam means cooperable between the distal end of said arm and said support assembly means for biasing said support assembly means throughout a range of vertical travel and continuously varying an effective moment arm of said arm to compensate for changing force of the spring biasing of said arm wherein force on said support assembly means is substantially equalized through its range of vertical travel;

said cam means including a cam member on said arm and said cam member having a curvilinear concave cam surface.

2. The support structure of claim 1 wherein said arm is biased by a torsion spring disposed coaxially with said axis.

3. The support structure of claim 1 including means for adjusting the spring biasing force on the arm such that the support surface can be counterbalanced with different loads placed thereon.

4. The support structure of claim 1 including two spring biased pivotable arms cooperable with said support assembly means.

5. The support structure of claim 1 including a cam follower on said support assembly wherein said cam follower rides on said cam surface and said effective moment arm of said arm is altered throughout said range of vertical travel of said support assembly means.

6. The support structure of claim 5 wherein said effective moment arm is increased as said support assembly means moves to a downward position to thereby compensate for increased biasing force of said spring biased arm.

7. The support structure of claim 5 wherein said cam follower is supported on said support assembly means by a bracket extending inwardly of said frame.

8. The support structure of claim 7 wherein said bracket supports a roller and said frame includes a vertical support tube in alignment with said roller wherein said roller rides on said tube to stabilize said support assembly means against lateral forces imposed thereon by said associated pivot arm.

9. The support structure of claim 5 wherein said follower has a curved surface defined by a radius and said cam surface has a profile defined substantially by the expressions $$Rx'=r\cos\gamma+(d-r_r)\cos(\beta+\theta)$$

$$Ry'=r\sin\gamma+(d-r_r)\sin(\beta+\theta)$$

where Rx' and Ry' define coordinates on a local x' and y' coordinate system on the arm, r represents a distance between said cam surface and said axis, $\gamma$ is a corresponding angle of rotation of an r vector with respect to said x' coordinate system at a given value of r, $\theta$ is a corresponding angle of rotation of the arm at given values of r and $\gamma$, $\beta$ is a corresponding angle normal to the cam surface at its point of contact with the follower for given values of r, $\gamma$ and $\theta$ as measured relative to a world coordinate system, D is the distance to a corresponding center of curvature of the cam surface and $r_r$ is the radius of the cam follower.

* * * * *